US007905300B2

(12) United States Patent
Rieder et al.

(10) Patent No.: US 7,905,300 B2
(45) Date of Patent: Mar. 15, 2011

(54) DRILLING DEVICE AND DRILLING METHOD UTILIZING DUAL DRIVES

(75) Inventors: Otto Rieder, Pfaffenhofen (DE); Stefan Hackl, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 230 days.

(21) Appl. No.: 12/292,860

(22) Filed: Nov. 26, 2008

(65) Prior Publication Data

US 2009/0139731 A1 Jun. 4, 2009

(30) Foreign Application Priority Data

Dec. 3, 2007 (EP) ..... 07023381

(51) Int. Cl.
*E21B 1/02* (2006.01)
*E21B 19/08* (2006.01)

(52) U.S. Cl. ..... 175/122; 175/162

(58) Field of Classification Search ..... 175/122, 175/162, 57; 173/164; 166/77.2, 77.1, 77.51
See application file for complete search history.

(56) References Cited

U.S. PATENT DOCUMENTS

| | | | | |
|---|---|---|---|---|
| 4,005,851 | A * | 2/1977 | Plote | 254/385 |
| 4,671,365 | A | 6/1987 | Back | |
| 6,003,598 | A * | 12/1999 | Andreychuk | 166/76.1 |
| 6,581,698 | B1 * | 6/2003 | Dirks | 175/52 |
| 6,763,898 | B1 * | 7/2004 | Roodenburg et al. | 175/7 |
| 7,802,636 | B2 * | 9/2010 | Childers et al. | 175/52 |
| 2003/0056988 | A1 * | 3/2003 | Smith | 175/57 |
| 2006/0231269 | A1 * | 10/2006 | Wood | 166/384 |
| 2007/0261857 | A1 * | 11/2007 | Kuttel et al. | 166/380 |
| 2009/0314547 | A1 * | 12/2009 | Stoetzer et al. | 175/57 |

FOREIGN PATENT DOCUMENTS

| | | | |
|---|---|---|---|
| DE | 1215624 | A | 5/1966 |
| DE | 10123403 | A1 | 7/2002 |
| DE | 101 13 561 | A1 | 9/2002 |
| EP | 011 41 46 | A | 7/1984 |
| EP | 0 548 900 | A | 6/1993 |
| EP | 1 580 398 | A | 9/2005 |
| RU | 2188294 | C1 | 8/2002 |
| SU | 130010 | A | 8/1960 |
| SU | 1388534 | A1 | 4/1988 |
| WO | WO 2006/110040 | A | 10/2006 |

* cited by examiner

*Primary Examiner* — Giovanna C Wright
*Assistant Examiner* — Sonya Bible
(74) *Attorney, Agent, or Firm* — Jacobson Holman PLLC

(57) ABSTRACT

The invention relates to a drilling device and a related drilling method, in which provision is made for a mast, a drilling carriage that is guided along the mast in a displaceable manner and a drive unit for moving the drilling carriage on the mast. In accordance with the invention the drive unit has both a hydraulic cylinder drive and a rope winch drive. The drilling carriage can be coupled with the hydraulic cylinder drive and with the rope winch drive.

11 Claims, 6 Drawing Sheets

DRILLING DEVICE AND DRILLING METHOD UTILIZING DUAL DRIVES

BACKGROUND OF THE INVENTION

1. Field of the Invention

The invention relates to a drilling device comprising a mast, a drilling carriage which is guided along the mast in a displaceable manner and a drive unit for moving the drilling carriage on the mast.

The invention further relates to a drilling method for producing a drill hole, in which a first rod and a second rod are moved and in particular introduced into the ground with a drilling carriage, which is guided on a mast.

2. Description of related art including information disclosed under 37 CFR §§1.97 and 1.98

In drilling devices of such type, which are employed in particular in deep-hole drilling, there are usually two main modes of operation. These comprise the drilling on the one hand and the lining of the drill hole with casing pipes on the other hand. The first main mode of operation, which claims the largest part of the operating time, serves for the drilling or extraction of drill rod segments. In this case the change of the rod segments has to take place rapidly because during this time the flushing of the drilling is interrupted. In doing so there is a risk of the drill head getting stuck.

On reaching a certain drilling depth the drill hole has to be lined with casing pipes and concreted against the soil externally in order to stabilize the drill hole and prevent a contamination of the various soil layers, as for example during gas or oil drilling. For this purpose rod segments of greater length are installed, connected to one another and then concreted from the outside. To this end the feeding system requires great tensile forces.

A drilling device, in which a telescopic mast can be moved by a hydraulic cylinder, is known from EP 0 114 146 A.

BRIEF SUMMARY OF THE INVENTION

The invention is based on the object to provide a drilling device and a drilling method, by means of which an efficient operation in the different main modes of operation is rendered possible.

In accordance with the invention the object is solved on the one hand by a drilling device having a mast, a drilling carriage which is guided along the mast in a displaceable manner, and a drive unit for moving the carriage on the mast, wherein the drive unit has both a hydraulic cylinder drive and a rope winch drive and the drilling carriage can be coupled with the hydraulic cylinder drive and with the rope winch drive; and on the other hand by a drilling method for implementation with such a drilling device, to produce a drill hole, in which a first rod and a second rod are moved and in particular introduced into the ground with a drilling carriage, which is guided on a mast, wherein for the introduction of the first rod the drilling carriage is moved with a hydraulic cylinder drive and for the introduction of the second rod the drilling carriage is moved with a rope winch drive.

The drilling device according to the invention is characterized in that the drive unit has both a hydraulic cylinder drive and a rope winch drive and in that the drilling carriage can be coupled with the hydraulic cylinder drive and with the rope winch drive.

With the two different drives it is possible to implement the different modes of operation in an efficient manner. The hydraulic cylinder drive permits high feeding and movement speeds, which prove to be especially advantageous during drilling or extraction of the drill rod segments. The rope winch drive, in turn, can be used effectively during the lining of the drill hole, for instance by introducing the casing pipes. For these operations a feeding system with high tensile forces is required. This can be achieved in a cost-saving and compact way by a rope winch drive, with which high tensile forces are made available at reduced feeding speeds in particular due to a multiple reeving of the hoisting rope in line with the chain block principle.

In principle, during both modes of operation the drilling carriage can be connected to both the hydraulic cylinder drive and the rope winch drive. However, according to the invention it is especially useful that a coupling device is provided, by means of which the drilling carriage can be connected alternately to the hydraulic cylinder drive and the rope winch drive. The coupling device can be operated manually, for example by insertable retaining bolts, or automatically, for example by corresponding hydraulic cylinders that actuate a lock mechanism on the drilling carriage.

According to the invention it is particularly preferable that the mast has a mast base element and at least one telescopic mast element, which is guided in a telescopic manner in the mast base element, and that for movement of the at least one telescopic mast element the hydraulic cylinder drive can be coupled with the former. In this manner the hydraulic cylinder drive can be used not only for movement of the drilling carriage but also for telescoping the mast. The telescopic facility of the mast proves to be especially useful for the set-up of the drilling device, in which case the mast is pivoted from a substantially horizontal transport position into the substantially vertical operating position. The smaller the dimension of the mast in this operation, the lower the raising forces required. Moreover, the extension of the mast is useful if, for the purpose of lining the drill hole after the drilling, casing pipes with rod segments are used, the length of which is greater than the length of the drill rod segments.

A high flexibility with regard to the movement path of the drilling carriage is achieved in accordance with the invention in that the drilling carriage has a first guide for guidance along the mast base element and at least a further guide for guidance along the at least one telescopic mast element. On account of its telescopic facility the telescopic mast element has a different shape, usually a smaller one than that of the mast base element. To ensure here a reliable guidance of the drilling carriage, the mast base element has a first guide that differs from the second guide on the telescopic mast element. These can be guide rails or guide grooves in particular. On the drilling carriage corresponding slide shoes or guide shoes are provided for the two guides so that when the mast is extended the drilling carriage can be moved without transition from the mast base element to the telescopic mast element. According to the number of telescopic mast elements provision can also be made for more than two guides.

Furthermore, provision is made in accordance with the invention for the rope winch drive to have a rope winch, which is arranged on the bed of the drilling device, and a rope, which is guided via a pulley arrangement on the mast head of the mast. With this arrangement high tensile forces can be applied via the mast head onto the drilling carriage. This applies in particular if the pulley arrangement provides for an additional force transmission in accordance with the chain block principle. The arrangement of the rope winch on the bed of the drilling device allows for a stable construction and a direct introduction of force into the stable bed of the device.

In this context, it is especially preferred that for the purpose of pivoting of the mast in or from the vertical, the rope winch drive can be connected to the mast. In this way the rope winch drive can also be used to raise the mast from the substantially horizontal transport position into the vertical operating position. To this end the rope has to be detached from the drilling carriage and attached to a point of attachment provided on the rear strut arrangement of the mast.

According to the invention a stable construction is fostered by the fact that the hydraulic cylinder drive has at least one hydraulic cylinder that is arranged on the base of the mast. In addition to the point of articulation located on the base of the mast the hydraulic cylinder has a further point of articulation that is detachably fixed on the drilling carriage. For the telescopic facility of the telescopic mast element the detachable fixing point of the hydraulic cylinder can thus be coupled to the telescopic mast element so as to retract or extend the latter.

The drilling method according to the invention is characterized in that for the introduction of the first rod the drilling carriage is moved with a hydraulic cylinder drive and for the introduction of the second rod the drilling carriage is moved with a rope winch drive. The hydraulic cylinder drive permits a quick movement which is especially advantageous for the inner drill rod segments. The rope winch drive in turn permits the application of high feeding forces, as required during the introduction of casing pipes.

In accordance with the invention it is of advantage that the first rod is an inner drill rod and the second rod is an outer pipe rod. On the ground-facing end of the inner drill rod the drill head is located. The outer pipe rod can be employed for lining and concreting the drill hole in order to secure it.

Furthermore, it is preferred according to the invention that the first rod is composed of first rod segments and the second rod is composed of second rod segments, that the first rod segments have a length that is smaller than the length of the second rod segments, that before the introduction of the second rod a telescopic mast element is extended on a mast base element for extension and that the second rod is introduced segment by segment into the ground by moving the drilling carriage along the extended mast. Alternatively, the segments of the first rod can also be longer than those of the second rod.

The drilling method according to the invention allows for an efficient operation in both main modes of operation. For example for the drilling with a drill rod the drilling carriage can be moved solely along the mast base element. In this case use can be made of shorter drill rod segments. If in the other main mode of operation longer casing pipes are used as second rod for instance for lining the drill hole, the mast can be extended for these longer rod segments.

According to the invention a drilling device and a drilling method are achieved in all, in which case the drilling device is much more cost-saving as compared to conventional drilling devices with a comparable performance. For, a considerably larger dimensioning of the rope winch drive would be required in order to reach with a rope winch drive both the high feeding speeds of a hydraulic cylinder and at the same time the necessary high feeding forces.

BRIEF DESCRIPTION OF THE SEVERAL VIEWS OF THE DRAWINGS

The invention will be described further by way of preferred embodiments which are shown schematically in the drawings, wherein.

DETAILED DESCRIPTION OF THE INVENTION

Figure 1:
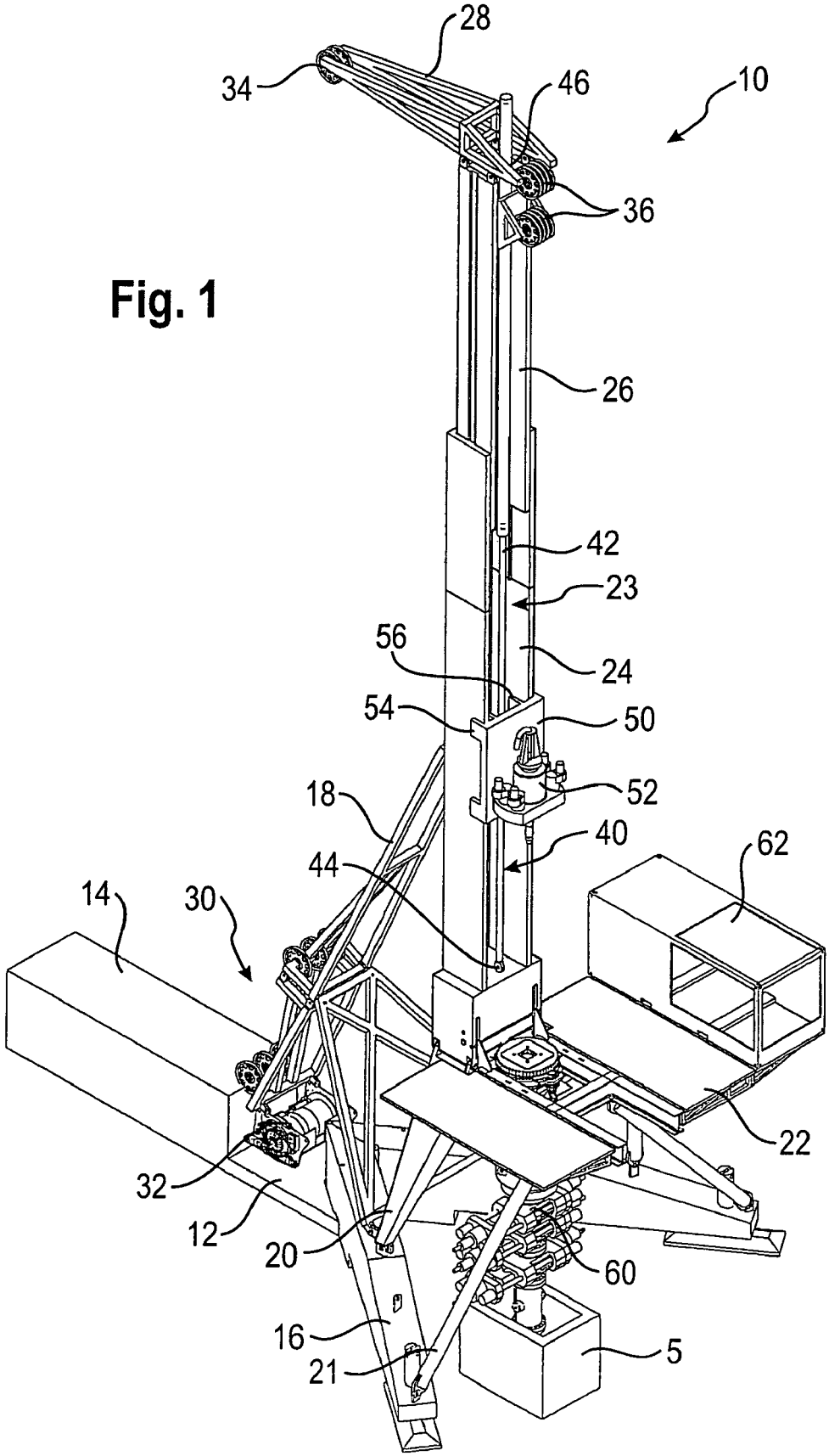
FIG. 1 shows a perspective view of a first drilling device according to the invention.
Figure 2:
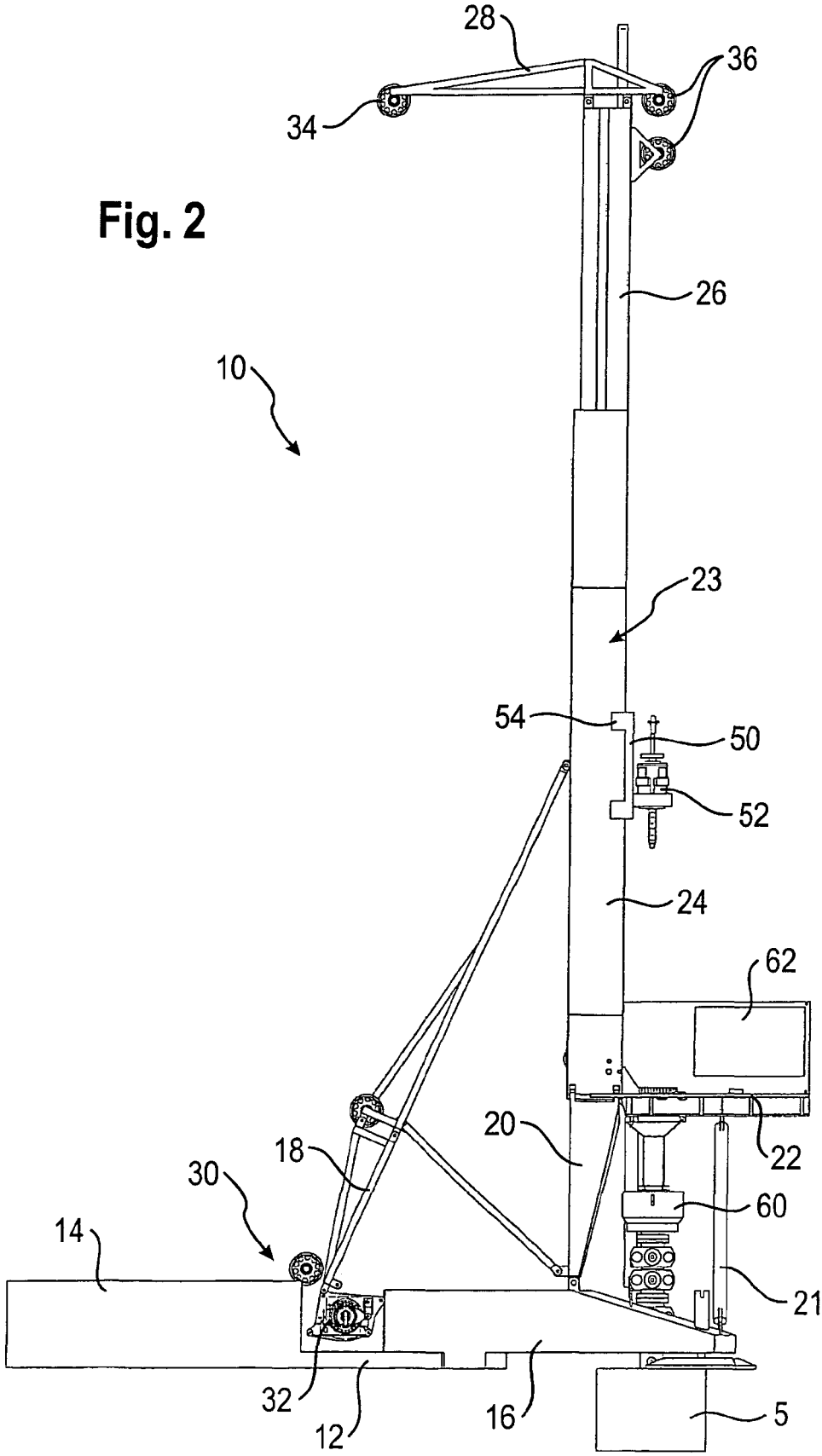
FIG. 2 shows a side view of the drilling device of FIG. 1.

FIGS. 1 and 2 show a first drilling device 10 according to the invention with a bed 12, in which a container-shaped power unit 14 for the energy and hydraulic supply is arranged. At the opposite end of the bed 12 a fork-shaped ground support 16 is provided which extends around a drill hole frame 5. On the legs of the fork-shaped ground support 16 a mast 23 is articulated in a pivotable manner by means of a V-shaped bipod 20. On the rear side of the mast 23 that faces away from the drill hole frame 5 said mast is supported with respect to the bed 12 through a strut arrangement 18 with a so-called A-trestle.

On the transition of the mast 23 to the bipod 20 the substantially horizontally extending drilling table 22 with a box-shaped control station 62 is mounted. Below the drilling table 22, which is supported by struts 21 with respect to the fork-shaped ground support 16, a blowout-preventer 60 with corresponding clamping devices is provided in a known manner for screw-connecting and breaking the individual rod segments.

In the illustrated embodiment of the drilling device 10 the mast 23 is designed in a telescopic manner with a mast base element 24, in which a telescopic mast element 26 is guided in a displaceable manner. The mast base body 24 and the telescopic mast element 26 have rail-like guides at their front sides, along which a drilling carriage 50 with a rotary head 52 is guided in a displaceable manner along the mast 23. On the side directed towards the mast the drilling carriage 50 has guide shoes as a first guide 54 and a second guide 56, which, together with the guide on the mast base element 24 or with the guide on the telescopic mast element 26, respectively, provide a reliable linear displacement of the drilling carriage 50.

In accordance with the invention the drilling carriage 50 can be moved both by a hydraulic cylinder drive 40 and by a rope winch drive 30. The rope winch drive 30 has a drum-shaped rope winch 32 with a rotary drive. The rope winch 32 is arranged on the bed 12 between the fork-shaped ground support 16 and the power unit 14. By means of a deflection pulley 34 located on the mast head 28 a rope not depicted here is connected via a pulley arrangement 36 along the mast 23 to the drilling carriage 50. By way of a multiple reeving of the rope in the pulley arrangement 36 an increase in the tensile force according to the chain block principle is achieved in order to displace the drilling carriage 50. To the same extent that the tensile force increases, the displacement speed of the rope winch drive 30 decreases.

According to the invention to achieve a quicker displacement in the case of lower tensile forces the drilling carriage 50 can be coupled with the hydraulic cylinder drive 40. The hydraulic cylinder drive 40 has a hydraulic cylinder 42 that extends along the mast 23, which is U-shaped in cross-section, in the inner space thereof. The hydraulic cylinder 42 has a lower point of attachment 44 and an upper point of attachment 46. By way of these points of attachment 44, 46 the hydraulic cylinder 42 can be connected optionally to the base of the mast 23, to the drilling carriage 50 or to the displaceable telescopic mast element 26.

According to the invention the telescopic mast element 26 can be extended from the mast base element 24 for extension of the mast 23 especially in those cases where longer rod segments have to be drilled in or extracted. Depending on the desired feeding speed or the required tensile forces, the drilling carriage 50 can then be operated either by the rope winch drive 30 or by the hydraulic cylinder drive 40.

Figure 3:
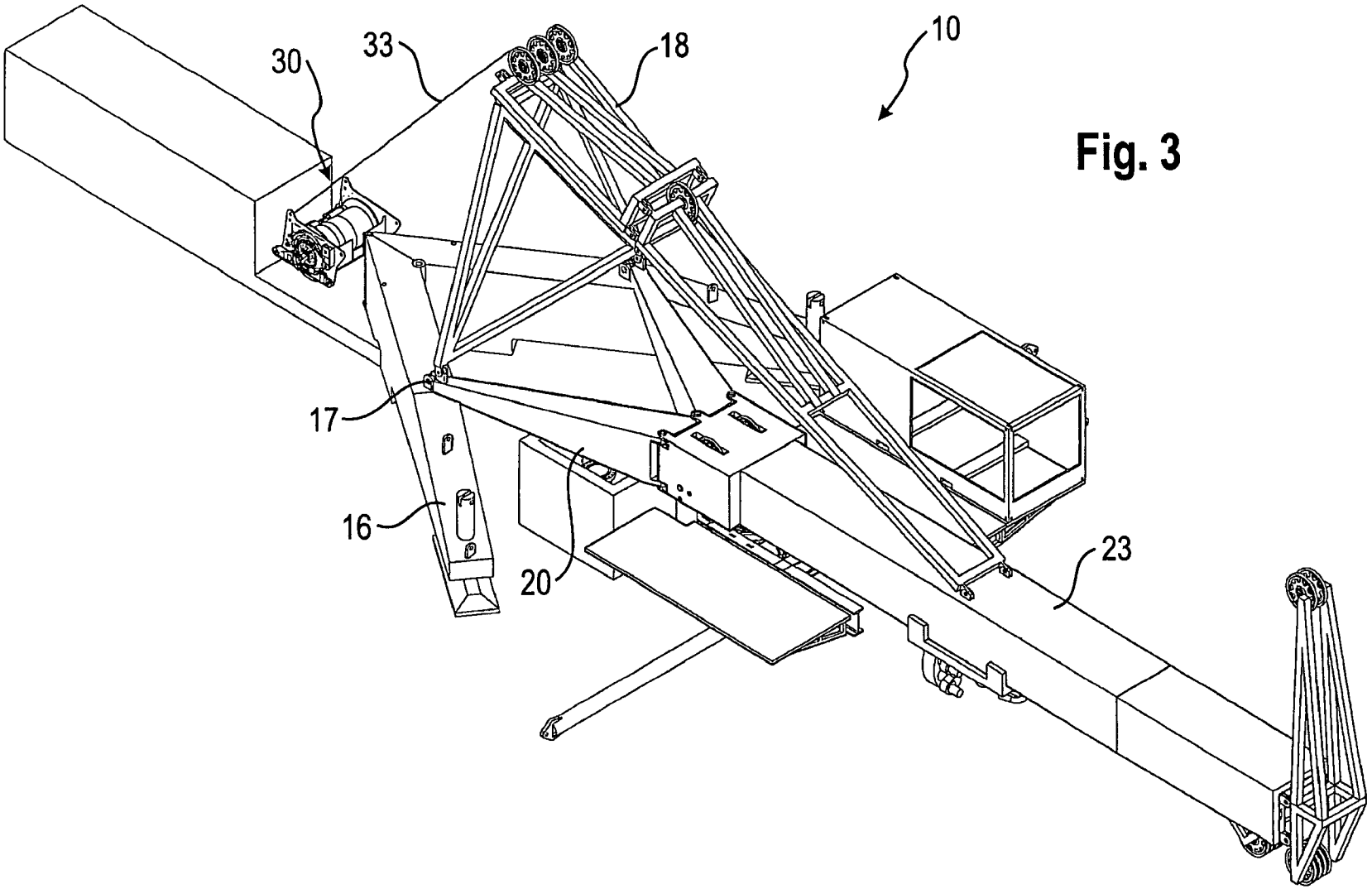
FIG. 3 shows a perspective view of the drilling device of FIG. 1 with a pivoted mast.

FIG. 3 shows the drilling device 10 in the folded assembly position, in which the mast 23 is articulated by means of the pivot joints 17 located at the lower end of the bipod 20 to the fork-shaped ground support 16. To raise the mast 23, which is in its telescoped condition in order to reduce forces, the rope winch drive 30 can be employed. To this end the rope 33, illustrated in part only, is articulated by means of the folded strut arrangement 18 to the mast 23. In this way the mast 23 can be pivoted from its horizontal transport position into the vertical operating position and vice versa.

Figure 4:
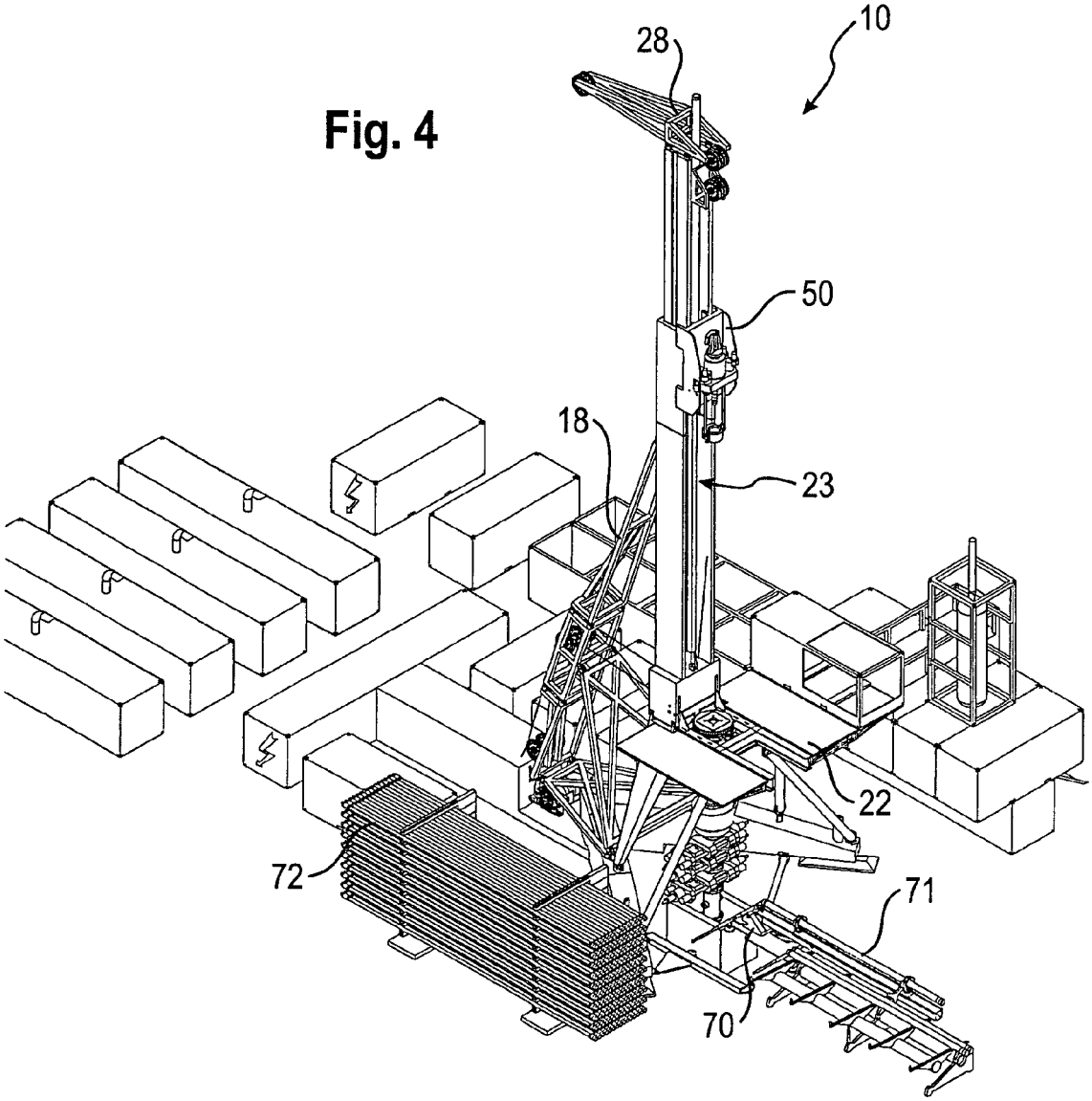
FIG. 4 shows a perspective view of a further drilling device according to the invention with equipment.

A further drilling device 10 is shown in FIG. 4. This drilling device 10 substantially corresponds to the previously described drilling device. Unlike the afore-mentioned device, a different strut arrangement 18 with a box-shaped intermediate element is chosen in this case.

The drilling device 10 according to FIG. 4 is shown with the equipment commonly used at drilling sites. First rod segments 71 are pivoted by an as such known handling device 70 from a horizontal starting position into a vertical position and lifted on the level of the drilling table 22. By means of the drilling carriage 50 the first drill rod segments 71 can be screw-connected to one another so as to form the first rod and introduced segment by segment into the ground. The dismantling of the first rod takes place in the reverse order.

In addition, a second rod composed of second rod segments 72 can be introduced with the drilling carriage 50. In the illustration according to FIG. 4 said rod segments are arranged in a pipe rod store. The length of the second rod segments 72 is greater than the length of the first rod segments 71. For movement of the longer second rod segments 72 the mast 23 can be extended, as illustrated, so that the drilling carriage 50, on being moved towards the upper mast head 28, is also able to receive the second rod segments 72 and introduce them into the ground or extract them respectively.

Figure 5:
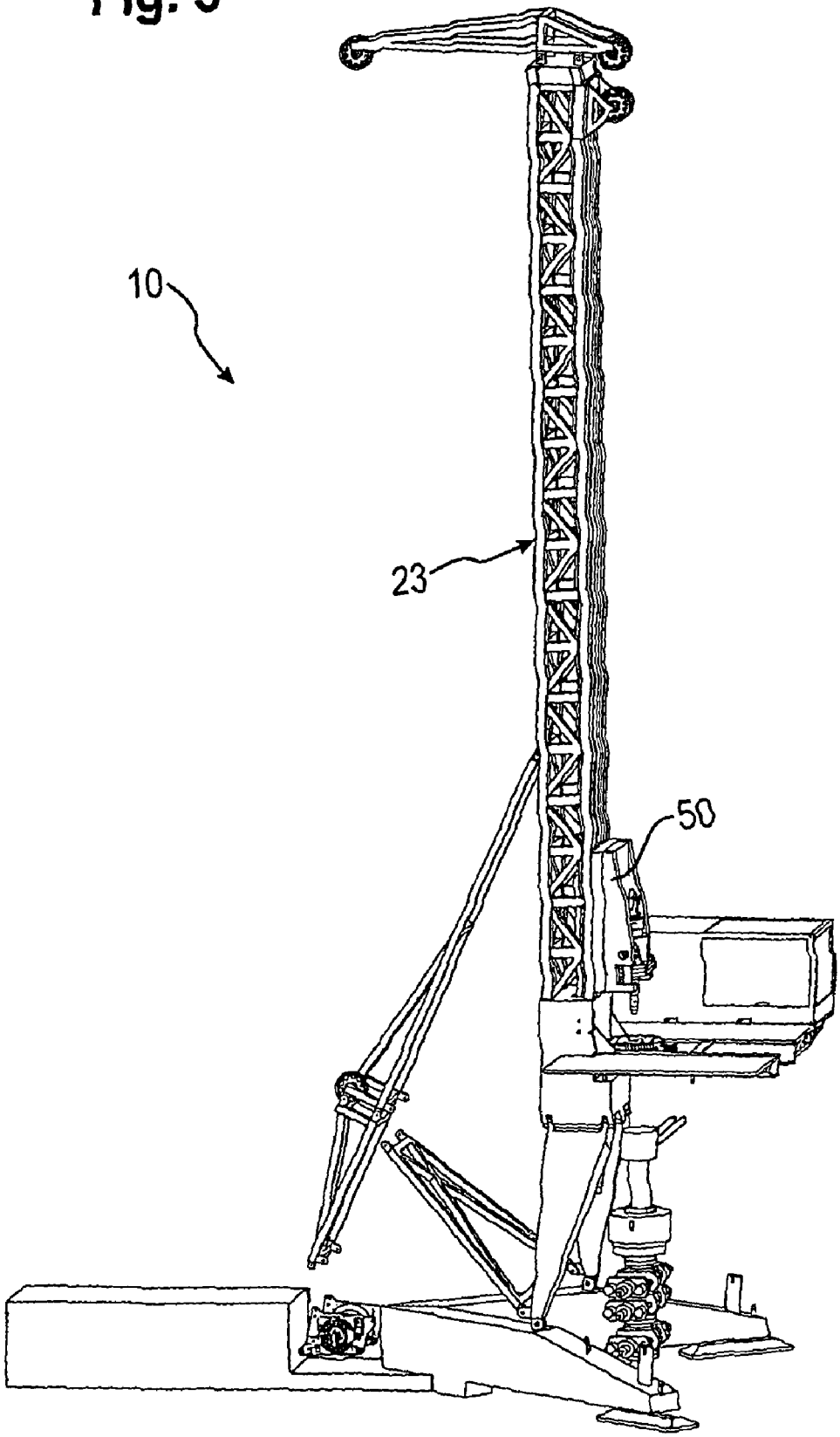
FIG. 5 shows a perspective view of a further drilling device according to the invention and FIG. 6 shows a front view of the drilling device of FIG. 5.
Figure 6:
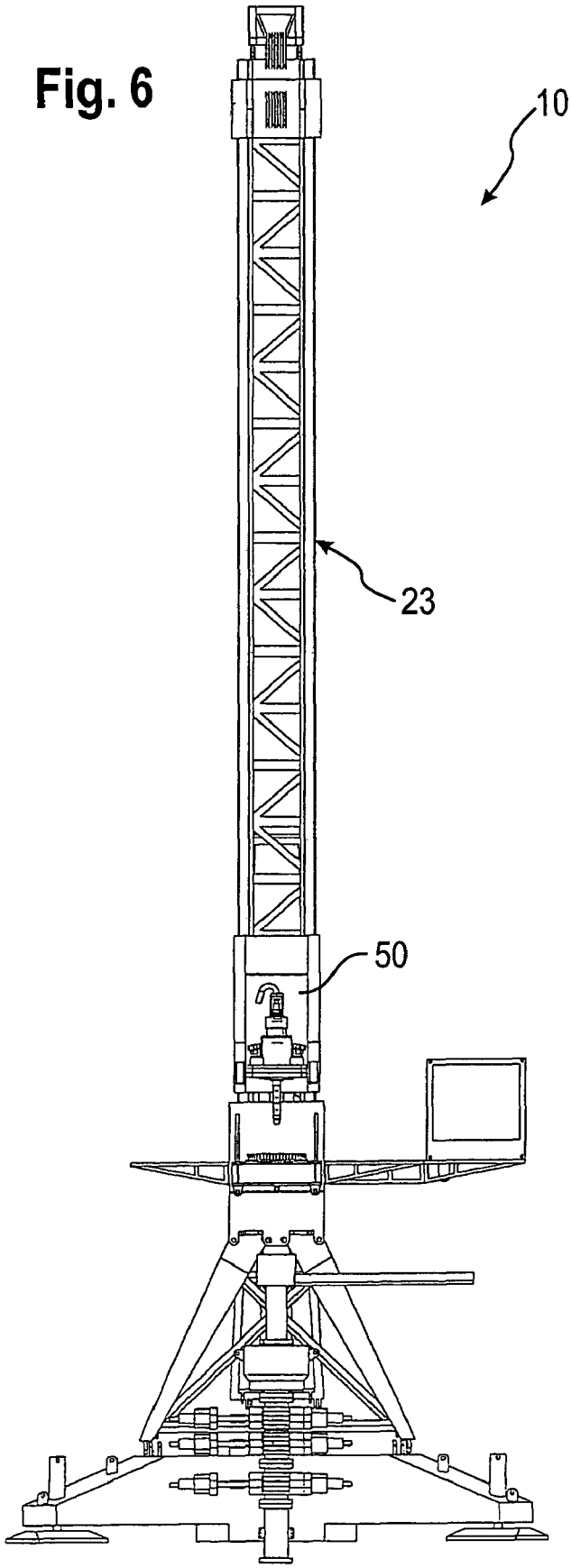

In FIGS. 5 and 6 a further drilling device 10 according to the invention is shown. This device substantially corresponds to the previously described drilling devices so that in the following only the varying construction of details will be depicted.

In the drilling device 10 according to FIGS. 5 and 6 a single-piece mast 23 with a fixed mast length is provided. The length of the mast 23 is designed to match the largest anticipated length of a rod segment. In the case of shorter rod segments the drilling carriage 50 only moves up to the height in each case required on the mast 23.

The invention claimed is:

1. A drilling device comprising:

a mast, a drilling carriage which is guided along the mast in a displaceable manner, and a drive unit for moving the drilling carriage on the mast, wherein the drive unit has both a hydraulic cylinder drive and a rope winch drive and the drilling carriage is coupleable with the hydraulic cylinder drive and with the rope winch drive, the drilling carriage being movable on the mast either by the hydraulic cylinder drive or by the rope winch drive.

2. The drilling device according to claim 1, wherein the drilling carriage is connectable alternately to the hydraulic cylinder drive and the rope winch drive.

3. The drilling device according to claim 1, wherein:

the mast has a mast base element and at least one telescopic mast element, wherein the at least one telescopic mast element is guided in a telescopic manner in the mast base element, and the hydraulic cylinder drive is coupleable with the at least one telescopic mast element for movement of the at least one telescopic mast element.

4. The drilling device according to claim 3, wherein:

the drilling carriage has a first guide for guidance along the mast base element and at least a further, second guide (56) for guidance along the at least one telescopic mast element.

5. The drilling device according to claim 3, wherein the mast has a mast head, a pulley arrangement is provided on the mast head, the drilling device has a bed, and the rope winch drive has a rope winch, which is arranged on the bed of the drilling device, and a rope, which is guided via the pulley arrangement on the mast head.

6. The drilling device according to claim 1, wherein the rope winch drive is connectable to the mast in order to pivot the mast.

7. The drilling device according to claim 1, wherein the hydraulic cylinder drive has at least one hydraulic cylinder which is arranged on the base of the mast.

8. The drilling device according to claim 1, wherein the drilling carriage is operable depending on a desired feeding speed and depending on necessary tensile forces either with the rope winch drive or with the hydraulic cylinder drive.

9. A drilling method for implementation with a drilling device to produce a drill hole, wherein the drilling device includes a mast, a drilling carriage which is guided along the mast in a displaceable manner, and a drive unit for moving the drilling carriage on the mast, wherein the drive unit has both a hydraulic cylinder drive and a rope winch drive and the drilling carriage is coupleable with the hydraulic cylinder drive and with the rope winch drive, comprising the steps of:

moving the drilling carriage with the hydraulic cylinder drive to introduce a first rod into the ground and moving the drilling carriage with the rope winch drive to introduce a second rod into the ground.

10. The drilling method according to claim 9, wherein the first rod is an inner drill rod and the second rod is an outer pipe rod.

11. The drilling method according to claim 9, wherein the first rod is composed of first rod segments and the second rod is composed of second rod segments, and the first rod segments have a length that is smaller than the length of the second rod segments, the method further comprising the steps of:

extending the mast prior to the introduction of the second rod and introducing the second rod segment by segment into the ground by moving the drilling carriage along the extended mast.

* * * * *